US007077100B2

(12) United States Patent
Vogel et al.

(10) Patent No.: US 7,077,100 B2
(45) Date of Patent: Jul. 18, 2006

(54) COMBINED FUEL INJECTION VALVE-IGNITION PLUG

(75) Inventors: Manfred Vogel, Ditzingen (DE); Werner Herden, Gerlingen (DE); Rainer Ecker, Kornwestheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/509,346

(22) PCT Filed: Jan. 29, 2003

(86) PCT No.: PCT/DE03/00232

§ 371 (c)(1),
(2), (4) Date: Apr. 4, 2005

(87) PCT Pub. No.: WO03/083284

PCT Pub. Date: Oct. 9, 2003

(65) Prior Publication Data

US 2005/0224043 A1 Oct. 13, 2005

(30) Foreign Application Priority Data

Mar. 28, 2002 (DE) ..... 102 14 167

(51) Int. Cl.
*F02M 57/06* (2006.01)

(52) U.S. Cl. ..... 123/297

(58) Field of Classification Search ..... 123/297, 123/169 V, 169 R, 151, 152; 313/120
See application file for complete search history.

(56) References Cited

U.S. PATENT DOCUMENTS 2,795,214 A 6/1957 Shook, II
3,173,409 A 3/1965 Warren
3,996,915 A * 12/1976 Demetrescu ..... 123/297
4,029,986 A 6/1977 Lara et al.
4,062,327 A * 12/1977 Knights ..... 123/25 R
4,319,552 A * 3/1982 Sauer et al. ..... 123/297
4,693,218 A 9/1987 Nagakura
4,967,708 A * 11/1990 Linder et al. ..... 123/297
5,497,744 A * 3/1996 Nagaosa et al. ..... 123/297
6,073,607 A * 6/2000 Liber ..... 123/297
6,135,084 A 10/2000 Corneer (Continued)

FOREIGN PATENT DOCUMENTS

DE 41 40 962 1/1993

(Continued)

OTHER PUBLICATIONS

* Patent Abstracts of Japan, vol. 006, No. 058, Apr. 15, 1982 & (JP 57 000361, Nissan Motor Co. Ltd.), Jan. 5, 1982.

(Continued)

*Primary Examiner*—Mahmoud Gimie
(74) *Attorney, Agent, or Firm*—Kenyon & Kenyon LLP

(57) ABSTRACT

A fuel injector having an integrated spark plug is provided, the fuel injector providing direct injection of fuel into a combustion chamber of an internal combustion engine, and the spark plug for igniting the fuel injected into the combustion chamber. Also provided is a spark-plug insulator that insulates a first electrode and a second electrode which is set apart from the first electrode by a spark gap, the fuel injector and the spark-plug insulator of the spark plug being arranged in a shared housing. The spark gap has a width of 50 to 300 μm and is disposed in front of the fuel injector at a distance of 3 to 10 mm.

18 Claims, 3 Drawing Sheets

U.S. PATENT DOCUMENTS

| | | | | |
|---|---|---|---|---|
| 6,469,424 | B1 * | 10/2002 | Marable | 313/120 |
| 6,748,918 | B1 * | 6/2004 | Rieger et al. | 123/297 |
| 2005/0200255 | A1 * | 9/2005 | Yoshimoto et al. | 313/143 |

FOREIGN PATENT DOCUMENTS

| | | | |
|---|---|---|---|
| DE | 198 59 508 | | 7/1999 |
| DE | 198 28 848 | | 12/1999 |
| DE | 198 28 849 | | 12/1999 |
| DE | 100 15 916 | | 10/2001 |
| EP | 0 661 446 | | 5/1998 |
| JP | 57000361 | * | 1/1982 |

OTHER PUBLICATIONS

* Patent Abstracts of Japan, vol. 009, No. 202, Aug. 20, 1985 & (JP 60 065225 A, Nissan, Jidosha KK, Apr. 15, 1985.

* cited by examiner

COMBINED FUEL INJECTION VALVE-IGNITION PLUG

FIELD OF THE INVENTION

The present invention relates to a fuel injector having an integrated spark plug (fuel injector-spark plug combination).

BACKGROUND INFORMATION

A fuel injector having an integrated spark plug is described in European Patent 0 661 446. The fuel injector with integrated spark plug is used for the direct injection of fuel into the combustion chamber of an internal combustion engine and for igniting the fuel injected into the combustion chamber. Due to the compact integration of a fuel injector with a spark plug, it is possible to save installation space at the cylinder head of the internal combustion engine. The conventional fuel injector with integrated spark plug has a valve body, which forms a sealing seat together with a valve-closure member that is actuated by means of a valve needle. Adjacent to this sealing seat is a spray-discharge orifice, which discharges at an end face of the valve body facing the combustion chamber. A ceramic insulation element insulates the valve body from a housing body against a high-voltage, the housing body being able to be screwed into the cylinder head of the internal combustion engine. Located on the housing body is a ground electrode so as to form an opposite potential to the valve body acted upon by high voltage. In response to a sufficient high voltage applied to the valve body, a spark arc-over occurs between the valve body and the ground electrode connected to the housing body.

A disadvantage of the conventional fuel injector with the integrated spark plug is that the position of the spark arc-over is undefined with respect to the fuel jet discharged from the spray-discharge orifice, since it is possible for the spark arc-over to occur at virtually any location in the lateral region of a valve-body projection. Thus, the conventional fuel injector does not allow a sufficiently precise and reliable ignition of the so-called jet root of the fuel jet spray-discharged from the spray-discharge orifice. However, a reliable and temporally precisely defined ignition of the fuel jet is required to achieve reduced emissions. Furthermore, the discharge orifice of the fuel jet may be subject to continually worsening carbon fouling or coking, which affects the form of the spray-discharged jet. Another disadvantage is that the ceramic extrusion coat of the fuel injector is relatively cost-intensive.

It is also disadvantageous that the operating voltage required to generate an ignition spark normally amounts to up to 25 kV, so that, on the one hand, the components required for the voltage generation or voltage transformation are cost-intensive and require more space, and on the other hand, the components are subjected to heavy loads by the high voltages and therefore have a short service life.

SUMMARY OF THE INVENTION

In contrast, the fuel injector-spark plug combination of the present invention has the advantage over the related art that the spark gap of the spark plug is sufficiently short that even low voltages are sufficient to generate an ignition spark. The spark gap has a width of between 50 and 300 μm, with an axial clearance of 3 to 15 mm in front of the spray-discharge orifice.

It is advantageous in this context that the electrodes may have nearly any form, so that each installation and injection situation may be accommodated. The electrodes may be bent at a right angle both in the radial and the axial direction, or they may be bent in the shape of a graduated circle.

Furthermore, it is advantageous that the present invention is suitable for various designs of fuel injectors, e.g., for inwardly opening and outwardly opening fuel injectors.

The ends of the electrodes are advantageously beveled or taper in a conical shape so as to facilitate the spark arc-over.

DETAILED DESCRIPTION

Figure 1:
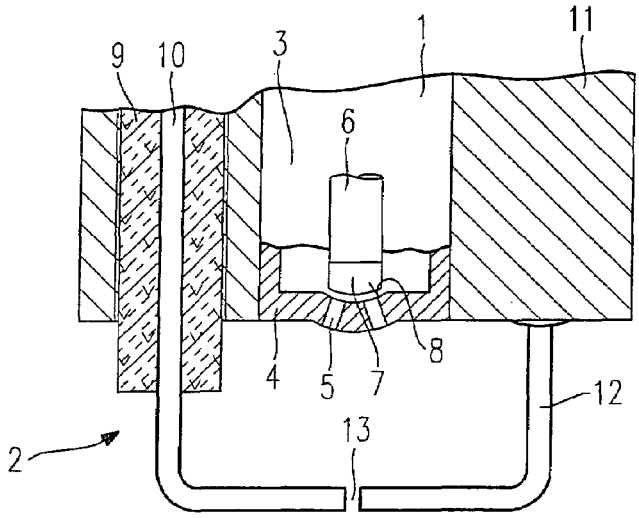
FIG. 1 depicts a schematic sectional view through the discharge-side end of a first exemplary embodiment of a fuel injector-spark-plug combination configured according to the present invention.

FIG. 1 shows a schematic partial longitudinal section of the end, on the spray-discharge side, of a fuel injector 1 having an integrated spark plug 2 (fuel injector-spark plug combination) for the direct injection of fuel into a combustion chamber of a mixture-compressing internal combustion engine having external ignition and for igniting the fuel injected into the combustion chamber.

Fuel injector 1 has a nozzle body 3 and a valve-seat member 4. A plurality of spray-discharge orifices 5 are arranged in valve-seat member 4; in the present exemplary embodiment, for example, there are five. Fuel injector 1 has a valve needle 6, which is disposed in nozzle body 3. At its spray-discharge side end, valve needle 6 has a valve-closure member 7, which forms a sealing seat together with a valve-seat surface 8 formed on valve-seat member 4. Shown in the present first exemplary embodiment of FIG. 1 is an inwardly opening fuel injector 1.

Fuel injector 1 may be configured as an electromagnetically actuated fuel injector or it may include a piezoelectric or magnetostrictive actuator for its actuation.

Spark plug 2 is made up of a spark-plug insulator 9, which is made of a ceramic material, for example, and a first electrode 10 located therein. First electrode 10 is electrically contactable by an ignition device (not shown further). Spark plug 2 and fuel injector 1 are housed together in a shared housing 11. At least one second electrode 12 is fixed on shared housing 11 in such a way that a spark gap 13 is formed between electrodes 10 and 12. Installing spark plug 2 and fuel injector 1 in shared housing 11 saves installation space that would otherwise be required for a separately disposed spark plug.

According to the present invention, spark gap 13 has a very narrow width, amounting to only 50 to 300 μm, and it is located 3 to 15 mm from spray-discharge orifices 5 of fuel injector 1. The narrow width of spark gap 13 is advantageous insofar as the ignition voltage required to generate an ignition spark between electrodes 10 and 12 is substantially lower than in conventional spark plugs. It varies between 5 and 8 kV, whereas conventional spark plugs require an ignition voltage of approximately 25 kV.

This has the advantage that the components providing the ignition voltage need not be designed for such high voltages, making the manufacture more cost-effective.

Furthermore, the loading of the electrical components is reduced, which increases the service life.

Electrodes 10 and 12 are also protected because electrode erosion caused by capacitive discharging may be greatly reduced, since this capacitive discharging is a function of the square of the voltage.

Figure 2A:
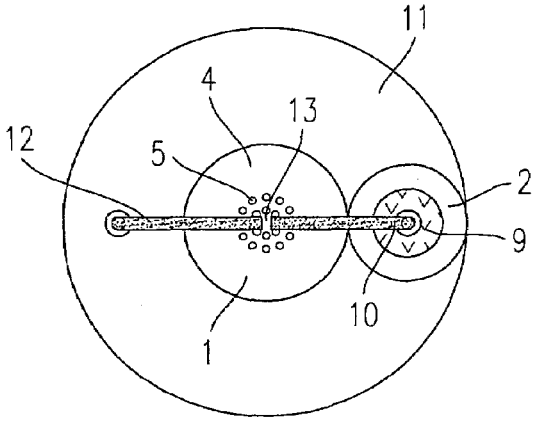
FIGS. 2A and 2B illustrate schematic views, counter to the spray-discharge direction, of two example arrangements of the electrodes of the spark plug.
Figure 2B:
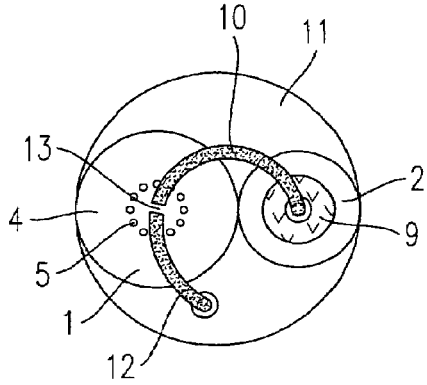

FIGS. 2A and 2B show two exemplary embodiments of electrodes 10 and 12 incorporated in the exemplary embodiment of a fuel injector 1 having an integrated spark plug 2 shown in FIG. 1. In each of FIGS. 2A and 2B, the direction of view is counter to the spray-discharge direction of the fuel, in the direction of valve-seat member 4 of fuel injector 1.

In FIG. 2A, electrodes 10 and 12 have a linear design and are situated diametrically opposite one another. This is advantageous because of simple manufacturability, since the electrodes need only be bent at right angles, as shown in FIG. 1, and no further reworking is required.

Electrodes 10 and 12 shown in FIG. 2B have a curved design, so that second electrode 12 is not disposed diametrically across from first electrode 10, as illustrated in FIG. 2A, but instead forms an at least partial circle therewith. This is advantageous insofar as shared housing 11 of fuel injector 1 and spark plug 2 may have a considerably slimmer design, so that the required installation space at the cylinder head is able to be reduced.

Figure 3A:
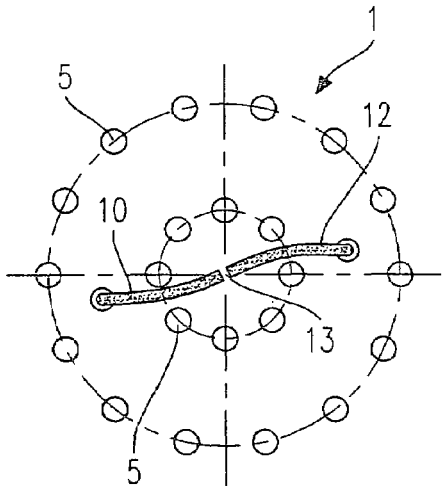
FIGS. 3A and 3B depict schematic views, counter to the spray-discharge direction, of two example arrangements of the spark gaps.

As can be gathered from FIGS. 1, 2A and 2B, electrodes 10 and 12 are arranged in such a way that spark gap 13 is always located inside the mixture cloud that is spray-discharged through spray-discharge orifices 5. This has the advantage that the mixture cloud is ignitable in a reliable manner due to the constantly present mixture flow and the resultant spark deflection. As shown in FIG. 3A, spark gap 13 may be axially disposed on a longitudinal axis 16 of fuel injector 1, centered above the concentric circles of spray-discharge orifices 5 of fuel injector 1, so that the mixture cloud is ignited in the center. The mixture cloud may then burn through very rapidly, since the flame paths towards the outer regions of the mixture cloud are only approximately half as long as in a peripheral arrangement of spark plug 2, which initially ignites the mixture cloud in an edge region.

Figure 3B:
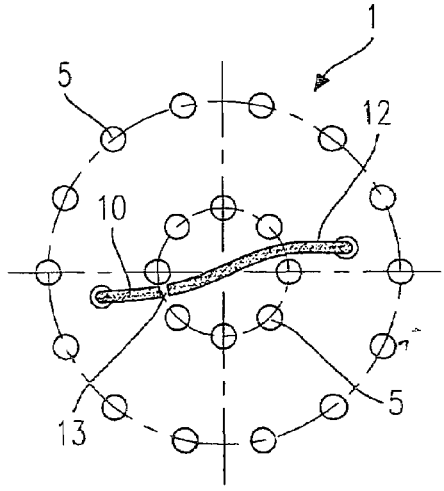

FIG. 3B illustrates another example embodiment of spark gap 13 relative to spray-discharge orifices 5. A suitable arrangement of spark gap 13 prevents, for example, electrodes 10 and 12 being exposed directly and too heavily to the spray, which would worsen the coking of electrodes 10 and 12, and thus increase malfunctions and resultant ignition misfirings. On the other hand, however, the centered position of spark gap 13 is maintained to the greatest possible degree so as to utilize the short flame paths.

Figure 4A:
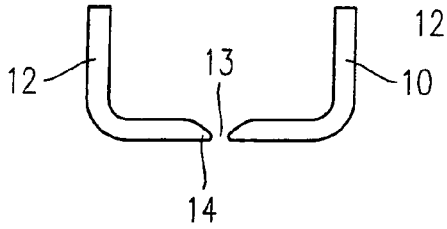
FIGS. 4A, 4B and 4C illustrate schematic representations of various example of the electrodes.
Figure 4B:
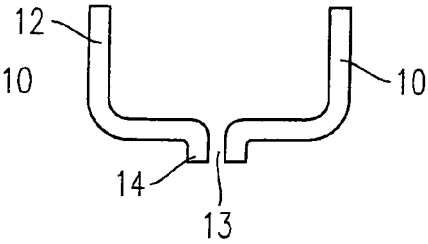
Figure 4C:
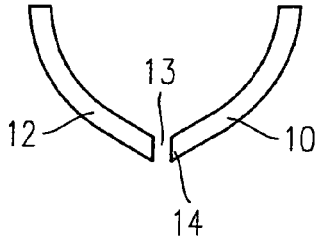

FIGS. 4A through 4*c* show example embodiments of electrodes 10 and 12, which are advantageously able to be used in fuel injector 1 with integrated spark plug 2 configured according to the present invention.

FIG. 4A shows electrodes 10 and 12 that incline toward one another at a right angle, ends 14 of electrodes 10, 12 being chamfered or having a conical form in order to facilitate the spark arc-over. The electrodes bent at right angles extend in parallel to an end face 17 of housing 11.

In the example embodiment shown in FIG. 4B, ends 14 of electrodes 10, 12 are bent upward once more, at a right angle, so that they are parallel to one another again.

This has the advantage that spark gap 13 is shielded from the mixture flow to some degree, so that the danger of coking and subsequent misfires is reduced.

Electrodes 10 and 12 in FIG. 4C are inclined toward one another without an abrupt angle, thereby making the arrangement especially easy to produce. Here, too, it must be noted that ends 14 of electrodes 10, 12 are at least chamfered or may even have a conical design in order to facilitate flame arc-over.

Figure 5A:
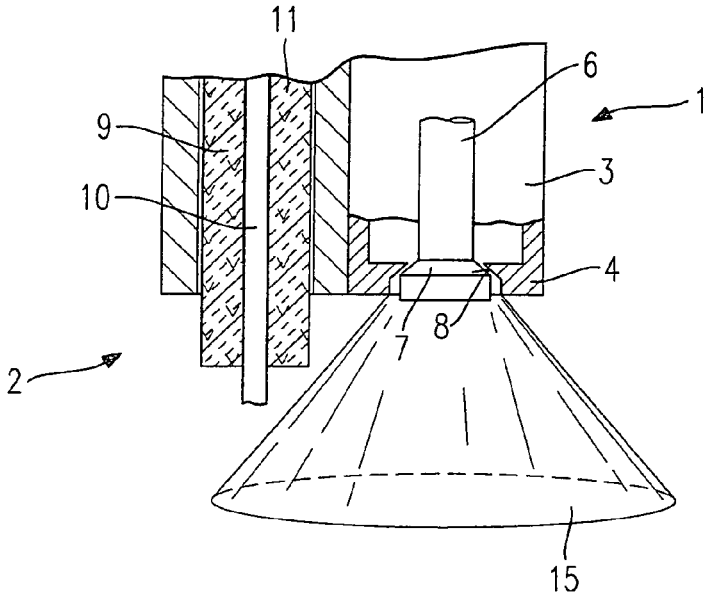
FIGS. 5A and 5B depict side and plan views, respectively, of the end, on the spray-discharge side, of a second exemplary embodiment of a fuel injector-spark plug combination configured according to the present invention.
Figure 5B:
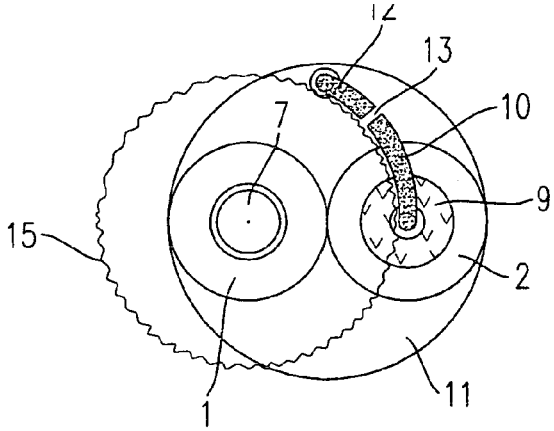

FIGS. 5A and 5B show a second exemplary embodiment of a fuel injector 1 with integrated spark plug 2, configured according to the present invention. In contrast to fuel injector 1 shown in FIGS. 1 through 3, fuel injector 1 is designed as an outwardly opening fuel injector.

FIG. 5A shows a schematic side view of the end, on the spray-discharge side, of fuel injector 1 and integrated spark plug 2.

As in the previous exemplary embodiment, fuel injector 1 has a nozzle body 3 in which a valve needle 6 is guided. At its spray-discharge side end, valve needle 6 has a valve-closure member 7, which forms a sealing seat together with a valve-seat surface 8 formed on valve-seat member 4. Due to the conical design of valve-closure member 7, fuel injector 1 sprays a mixture cloud 15 that has the shape of a cone envelope.

As can be seen from FIG. 5A, the axial length of electrodes 10, 12 is designed such that mixture cloud 15 does not completely envelop electrodes 10, 12 or spark gap 13 lying in-between, but grazes it tangentially. This is illustrated more clearly in FIG. 5B, which shows a plan view of the end, on the spray-discharge side, of fuel injector 1 and spark plug 2 counter to the spray-discharge direction. The axial height above the discharge region of the fuel amounts to approximately 5 mm. It is clear that the opening angle of cone-shaped mixture cloud 15 is just wide enough so that spark gap 13 lies in the region of the stoichiometric mixture without being directly exposed to the fuel spray. This is advantageous for the service life of spark plug 2, since the thermal-shock load is not as high and the erosion tendency of electrodes 10, 12 is reduced.

For the second exemplary embodiment of a fuel injector 1 with integrated spark plug 2, illustrated in FIGS. 5A and 5B, the exemplary embodiments of electrodes 10, 12 shown in FIGS. 4A through 4C, for example, may be utilized.

The diagrams of the injection and ignition characteristics in different load states of the internal combustion engines are provided in FIGS. 6A–6D to illustrate the operation of the present invention more clearly.

Figure 6A:
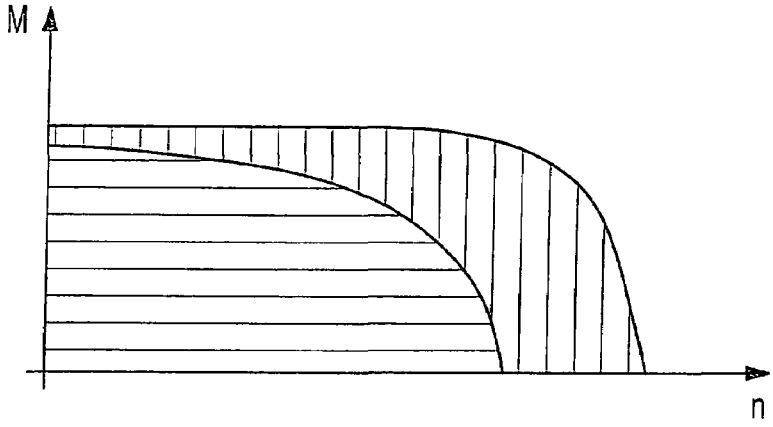
FIG. 6A illustrates a diagram of load M as a function of speed n of the internal combustion engine.
Figure 6B:
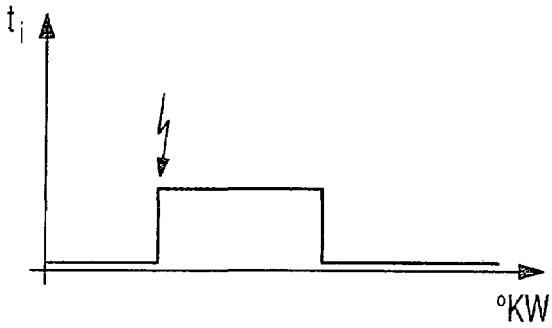
FIGS. 6B, 6C and 6D illustrate various diagrams of the injection and ignition characteristics in various operating states of an internal combustion engine, with a fuel injector-spark plug combination configured according to the present invention.

FIG. 6A schematically shows a simplified representation of the profile of load M as a function of speed n of the internal combustion engine. Operating states within the horizontally shaded area are known as stratified-charge operation or partial-load operation, whereas operating states inside the vertically shaded area are referred to as homogenous operation, homogenous lean operation or full throttle operation. FIGS. 6B and 6D refer to an operating state from the region of stratified-charge operation, while FIG. 6C illustrates an operating state from the region of homogenous operation.

FIG. 6B represents an examaple injection and ignition profile, which illustrates an injection phase over a time ti across a crankshaft angular range °KW. Ignition occurs shortly after injection begins in front of top dead center.

As an alternative, the injection and ignition characteristic shown in FIG. 6D is possible as well, in which a minimal quantity is injected for ignition after the actual injection.

Figure 6C:
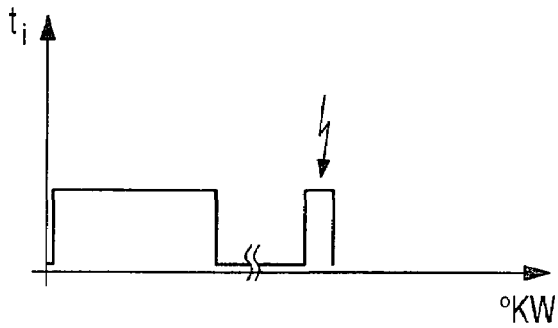
Figure 6D:
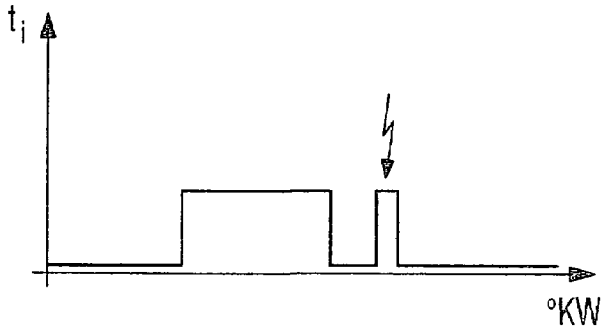

With the proviso that a larger crankshaft angular range lies between the main injection and the minimal-quantity injection, this is possible for homogenous operation, too, as shown in FIG. 6C.

The present invention is not limited to the exemplary embodiments shown, but also applicable to different designs of fuel injectors 1 and spark plugs 2.

What is claimed is:

1. A fuel injection system, comprising:

a fuel injector having spray-discharge orifice;

a spark plug having a spark plug insulator, a first electrode, and a second electrode, wherein the spark plug insulator at least partially surrounds the first electrode, and wherein the second electrode is set apart from the first electrode by a spark gap that has a width between approximately 50 to 300 micrometers and is disposed in front of the spray-discharge orifice with a clearance between approximately 3 to 15 millimeters, the first and second electrode having a curved design, so that the second electrode is not disposed diametrically across from the first electrode, but forms an at least partial circle therewith; and a shared housing surrounding the fuel injector and the spark plug insulator.

2. The fuel injector of claim 1, wherein the second electrode is fixed on the shared housing.

3. The fuel injector of claim 1, wherein the first electrode and the second electrode have a substantially rectilinear shape and are positioned substantially diametrically opposite to one another.

4. The fuel injector of claim 1, wherein the first electrode and the second electrode are bent in the form of a graduated circle.

5. The fuel injector of claim 1, wherein the first electrode has a first end, the second electrode has a second end, and the first end and the second end face one another.

6. The fuel injector of claim 5, wherein the first end and the second end are chamfered.

7. The fuel injector of claim 5, wherein the first end and the second end are tapered conically.

8. The fuel injector of claim 1, wherein:

the fuel injector has a longitudinal axis inside the shared housing; and the first electrode has a first portion and a first bent end, and the second electrode has a second portion and a second bent end, the first portion and the second portion being positioned substantially parallel to the longitudinal axis, and the first bent end and the second bent end forming the spark gap.

9. The fuel injector of claim 8, wherein the first bent end has a first angle, the second bent end has a second angle, and the first angle and the second angle are substantially right angles.

10. The fuel injector of claim 1, wherein the first electrode has a first arch, the second electrode has a second arch, and the first arch and the second arch form the spark gap.

11. The fuel injector of claim 1, wherein the first electrode has a first upward bend, the second electrode has a second upward bend, and the first upward bend and the second upward bend are substantially parallel to one another.

12. The fuel injector of claim 1, wherein the first upward bend has a first angle, the second upward bend has a second angle, and the first angle and the second angle are substantially right angles.

13. The fuel injector of claim 1, further comprising:

a plurality of spray-discharge orifices;

wherein the fuel injector is an inwardly opening fuel injector.

14. The fuel injector of claim 8, wherein the first portion has a first length, the second portion has a second length, and the first length and the second length are substantially the same length.

15. The fuel injector of claim 1, wherein the fuel injector has a longitudinal axis, and the spark gap is disposed in an axial extension of the longitudinal axis.

16. The fuel injector of claim 8, wherein the first portion has a first length, the second portion has a second length, and the first length and the second length are not substantially the same length.

17. The fuel injector of claim 1, wherein the fuel injector is an outwardly opening fuel injector.

18. The fuel injector of claim 17, wherein a mixture cloud is formed when a mixture is injected through the spray-discharge orifice, and the mixture cloud grazes the spark gap in a tangential manner.

* * * * *